US007311820B1

(12) United States Patent
Anderson

(10) Patent No.: US 7,311,820 B1
(45) Date of Patent: Dec. 25, 2007

(54) SWIMMING POOL RECIRCULATING WATER DISTRIBUTION HEADER

(76) Inventor: C. Arthur Anderson, 64 Summit Ave., Redlands, CA (US) 92373

( * ) Notice: Subject to any disclaimer, the term of this patent is extended or adjusted under 35 U.S.C. 154(b) by 235 days.

(21) Appl. No.: 11/192,695

(22) Filed: Jul. 29, 2005

Related U.S. Application Data

(60) Provisional application No. 60/592,938, filed on Jul. 30, 2004.

(51) Int. Cl.
*E04H 4/12* (2006.01)
*B05B 1/14* (2006.01)
*B08B 3/02* (2006.01)

(52) U.S. Cl. ..... 210/167.1; 210/416.2; 4/490; 4/507; 134/166 R

(58) Field of Classification Search ..... 210/167.01, 210/167.1, 167.12, 416.1, 416.2; 4/490, 4/507; 134/166 R
See application file for complete search history.

(56) References Cited

U.S. PATENT DOCUMENTS 1,855,258 A * 4/1932 Sirch ..... 4/507
3,521,304 A * 7/1970 Ghiz ..... 4/490
3,881,561 A * 5/1975 Pols et al. ..... 175/393
4,501,659 A * 2/1985 Henk ..... 210/167.1
4,640,784 A * 2/1987 Cant ..... 210/776
5,167,041 A * 12/1992 Burkitt, III ..... 4/541.2
5,392,472 A 2/1995 Maxfield
6,280,639 B1 * 8/2001 Ortiz ..... 210/776
6,419,840 B1 * 7/2002 Meincke ..... 210/767
6,578,207 B1 6/2003 Fratilla
2004/0164189 A1 * 8/2004 Berning et al. ..... 239/589.1

FOREIGN PATENT DOCUMENTS

DE 2004015864 * 1/2005

* cited by examiner

*Primary Examiner*—Fred G. Prince
(74) *Attorney, Agent, or Firm*—Kenneth L Tolar

(57) ABSTRACT

A water distribution header for a swimming pool recirculation system includes a nozzle having an arcuate face with a plurality of dispensing apertures positioned thereon. The dispensing apertures are in fluid communication with an inlet having a ball joint thereon that is coupled with the filtering system return line. The ball joint allows the angle between the header and return line to be selectively varied to assure that the nozzle is directed toward the bottom surface of the pool. Accordingly, the nozzle directs multiple, radially projecting streams of water toward the bottom of the pool thereby propelling any large debris resting thereon toward the filtering system intake drain.

4 Claims, 1 Drawing Sheet

SWIMMING POOL RECIRCULATING WATER DISTRIBUTION HEADER

CROSS REFERENCE TO RELATED APPLICATIONS

This application is entitled to the benefit of provisional application No. 60/592,938 filed on Jul. 30, 2004.

BACKGROUND OF THE INVENTION

The present invention relates to a uniquely designed header for securing to a swimming pool recirculating water line that directs debris towards the filtering system intake drain.

DESCRIPTION OF THE PRIOR ART

Most swimming pools include a recirculating filtering system having an intake drain at the bottom of the swimming pool through which water is diverted to a filter. The filtered water is redirected to the pool through a return line that is usually positioned on an interior wall, proximal the pool bottom. Because larger debris, such as leaves or twigs, settles on the bottom where the water is somewhat stagnant, the debris never enters the filtering system and remains in the pool indefinitely. Accordingly, additional tools such as sweepers, random action cleaners, nets and similar supplemental tools must be used to remove the debris. The present invention addresses this problem by providing a uniquely designed water distribution header that attaches to the swimming pool return water line for directing debris resting on the bottom toward the filtering system intake drain.

SUMMARY OF THE INVENTION

The present invention relates to a distribution header for a swimming pool recirculating water system. The device comprises a spray head having an inlet in fluid communication with a wide profile nozzle portion. The nozzle portion includes an arcuate front face having a plurality of dispensing apertures positioned thereon. At the inlet is a ball joint including a threaded collar that rides on a ball for coupling with an externally threaded nipple on the return line. The ball joint allows the angle of the header relative to the return line to be varied. Accordingly, a user attaches the header to the return water line and positions it so that the dispensing apertures point downwardly toward the bottom of the pool. The wide-profile, arcuate face projects multiple, radial streams of water toward the bottom of the pool thereby directing any debris resting thereon toward the filtering system intake drain.

It is therefore an object of the present invention to provide a distribution header for a swimming pool recirculation system that will effectively remove larger debris from swimming pools.

It is another object of the present invention to provide a distribution header for a swimming pool recirculation system that easily and conveniently directs debris towards a filtering system intake drain.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 2:
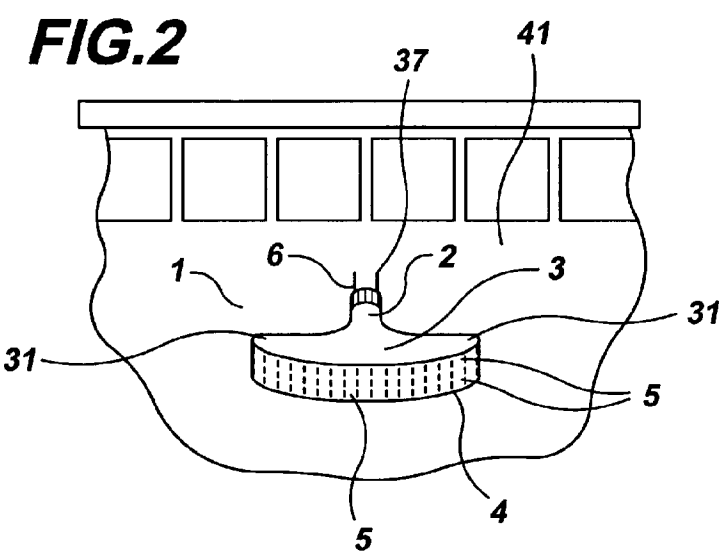
FIG. 2 is a perspective view of a distribution header according to the present invention.
Figure 1:
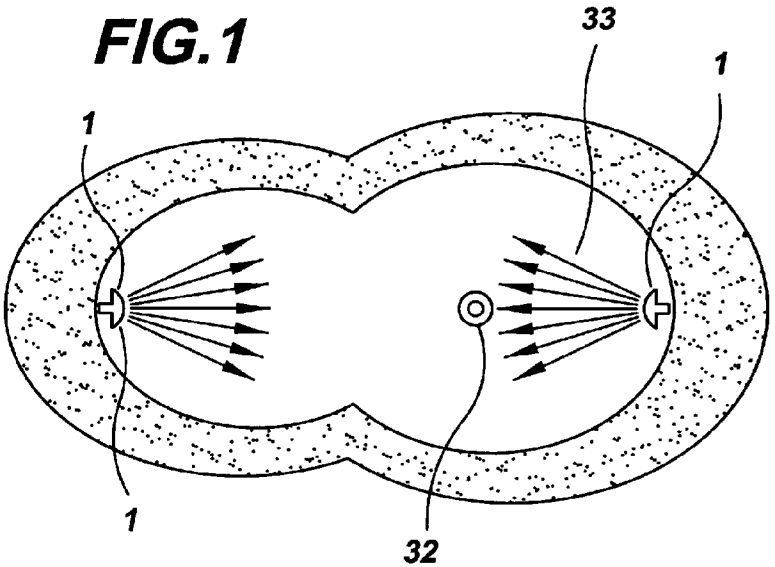
FIG. 1 is a top, plan view of a swimming pool with a pair of distribution headers according to the present invention mounted therein.
Figure 3:
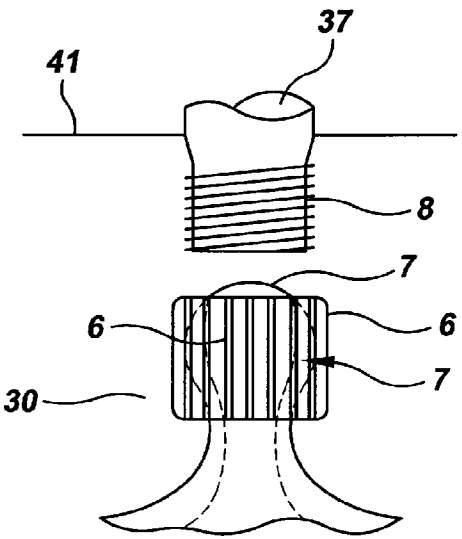
FIG. 3 is a detailed view of the ball joint mechanism for securing the header to a return water line.

The present invention relates to a distribution header for a swimming pool recirculating water system. A swimming pool recirculating water system typically includes a filter system intake drain 32 on the bottom surface of the pool and a return line 37 extending from one of the swimming pool sidewalls 41. The distribution header according to the present invention comprises a spray head 1 having an inlet 2 in fluid communication with a wide profile nozzle portion 3. The nozzle portion includes an arcuate front face 4 having a plurality of dispensing apertures 5 positioned thereon. The edges 31 of the nozzle portion are contoured so as not to injure those who inadvertently come in contact therewith.

At the inlet is a ball joint 30 including an internally threaded collar 6 that rides on a ball 7 for coupling with an externally threaded nipple 8 on the return line 37. The ball joint allows the angle of the nozzle portion relative to the return line to be adjusted so that the dispensing apertures can be directed toward the pool bottom. A second embodiment includes the nozzle portion extending at a discrete, fixed angle (20-30 degrees, for example) relative to the inlet line in which case the ball joint can be eliminated.

Accordingly, a user attaches the header to the return water line and orients it so that the dispensing apertures point downwardly toward the bottom of the pool. The wide-profile, arcuate face directs multiple, radially projecting streams 33 of water towards the bottom of the pool thereby propelling any debris resting thereon toward the filtering system intake drain 32.

The above described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. In combination with a swimming pool having a filtered water return line positioned on a sidewall thereof, a distribution header for a swimming pool recirculating water system comprising:

a spray head having an inlet in fluid communication with a wide profile nozzle portion, said nozzle portion including an arcuate front face with a plurality of dispensing apertures positioned thereon;

means for securing said inlet to said filtered water return line whereby said wide-profile, arcuate face projects radially extending streams of water toward a pool bottom surface thereby directing any debris resting thereon toward a filtering system intake drain.

2. The distribution header for a swimming pool recirculating water system according to claim 1 further comprising means for varying the angle between said inlet and said filtered water return line.

3. The distribution header for a swimming pool recirculating water system according to claim 2 wherein said means for varying the angle between said inlet and said filtered water return line comprises a ball joint on said inlet including a threaded collar that rides on a ball mounted on said inlet for coupling with an externally threaded nipple on the return line.

4. The distribution header for a swimming pool recirculating water system according to claim 1 wherein said nozzle portion extends at a discrete, oblique angle relative to the inlet line.

* * * * *